US011196170B2

(12) United States Patent
Chan et al.

(10) Patent No.: US 11,196,170 B2
(45) Date of Patent: Dec. 7, 2021

(54) ANTENNA DEVICE

(71) Applicants: Chun-Cheng Chan, Taipei (TW); Shih-Chia Liu, Taipei (TW); Li-Chun Lee, Taipei (TW); Chao-Lin Wu, Taipei (TW); Jui-Hung Lai, Taipei (TW); Yen-Hao Yu, Taipei (TW)

(72) Inventors: Chun-Cheng Chan, Taipei (TW); Shih-Chia Liu, Taipei (TW); Li-Chun Lee, Taipei (TW); Chao-Lin Wu, Taipei (TW); Jui-Hung Lai, Taipei (TW); Yen-Hao Yu, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 0 days.

(21) Appl. No.: 16/739,114

(22) Filed: Jan. 10, 2020

(65) Prior Publication Data

US 2021/0083394 A1 Mar. 18, 2021

(30) Foreign Application Priority Data

Sep. 16, 2019 (TW) ..... 108133152

(51) Int. Cl.

*H01Q 13/16* (2006.01)
*H01Q 5/10* (2015.01)
*H01Q 1/24* (2006.01)

(52) U.S. Cl.

CPC ..... *H01Q 13/16* (2013.01); *H01Q 1/24* (2013.01); *H01Q 1/243* (2013.01); *H01Q 5/10* (2015.01)

(58) Field of Classification Search

None

See application file for complete search history.

(56) References Cited

U.S. PATENT DOCUMENTS 8,223,082 B2 * 7/2012 Chiang ..... H01Q 1/2266 343/767
8,373,601 B2 * 2/2013 Wu ..... H01Q 5/371 343/700 MS
10,511,079 B2 * 12/2019 Wu ..... H01Q 1/2258
10,804,612 B2 * 10/2020 Wu ..... G06F 1/1616
2011/0316760 A1 * 12/2011 Wu ..... H01Q 9/42 343/905

FOREIGN PATENT DOCUMENTS

TW 201902032 1/2019

OTHER PUBLICATIONS

"Office Action of Taiwan Counterpart Application", dated Jun. 17, 2020, p. 1-p. 5.

* cited by examiner

*Primary Examiner* — Vibol Tan
(74) *Attorney, Agent, or Firm* — JCIPRNET

(57) ABSTRACT

An antenna device is provided in the disclosure. The antenna device includes a metal component, a signal cable, and a grounding component. The metal component includes a slot. The slot includes an open end and a closed end, and the open end forms an opening at a side of the metal component. The signal cable includes a signal portion and a grounding portion. The signal cable is disposed such that a projection of the signal portion is partially overlapped with the opening. The grounding portion is electrically connected to the metal component through the grounding component.

9 Claims, 3 Drawing Sheets

ANTENNA DEVICE

CROSS-REFERENCE TO RELATED APPLICATION

This application claims the priority benefit of Taiwan application serial no. 108133152, filed on Sep. 16, 2019. The entirety of the above-mentioned patent application is hereby incorporated by reference herein and made a part of this specification.

BACKGROUND OF THE DISCLOSURE

Field of the Disclosure

The disclosure relates to an antenna device.

Description of Related Art

With the development of a communication technology, more and more mobile devices may be used for wireless transmission. In order to shrink the sizes of the mobile devices and make the mobile devices more attractive, antennae embedded into circuit boards (such as printed circuit boards) gradually replace traditional antennae to become mainstreams in the market. Although the sizes of the mobile devices may be obviously shrunk by using this type of antennae, the usable areas of the circuit boards may be reduced, and therefore, the layout difficulty is increased.

In view of this, it is necessary to propose an antenna device capable of preventing an antenna from occupying the area of a circuit board.

SUMMARY OF THE DISCLOSURE

An antenna device is provided in the disclosure. The antenna device includes a metal component, a signal cable, and a grounding component. The metal component includes a slot. The slot includes an open end and a closed end, and the open end forms an opening at a side of the metal component. The signal cable includes a signal portion and a grounding portion. The signal cable is disposed such that a projection of the signal portion is partially overlapped with the opening. The grounding portion is electrically connected to the metal component through the grounding component.

In one embodiment of the disclosure, the slot is an L-shaped slot.

In one embodiment of the disclosure, the signal portion extends in a direction of a central axis of the closed end.

In one embodiment of the disclosure, a portion, surrounding the slot, of the metal component and the signal portion form a resonance path.

In one embodiment of the disclosure, the antenna device supports a first resonance mode and a second resonance mode. The first resonance mode corresponds to a low frequency band, and the second resonance mode corresponds to a high frequency band.

In one embodiment of the disclosure, the slot and the signal portion are disposed such that a length of the resonance path is equal to a ½ wavelength of the low frequency band.

In one embodiment of the disclosure, the slot and the signal portion are disposed such that a length of the resonance path is equal to a wavelength of the high frequency band. A frequency of the high frequency band is an integer multiple of that of the low frequency band.

In one embodiment of the disclosure, the slot is an L-shaped slot, the closed end corresponds to a first side, with a first side length, of the L-shaped slot, and the open end corresponds to a second side, with a second side length, of the L-shaped slot. The first side length, the second side length and a length of the signal portion are disposed to form the resonance path.

In one embodiment of the disclosure, the signal cable is a coaxial cable, the grounding portion is made of a metal material, and the signal portion includes a core and an insulating layer.

Based on the above, an antenna device with a small size may be composed by a metal component existing in an electronic device and a coaxial cable. A circuit board of the electronic device may be freely used according to a design demand. Therefore, the circuit board does not require to reserve a layout area for the antenna device.

In order to make the aforementioned and other objectives and advantages of the disclosure comprehensible, embodiments accompanied with figures are described in detail below.

DESCRIPTION OF THE EMBODIMENTS

Figure 1:
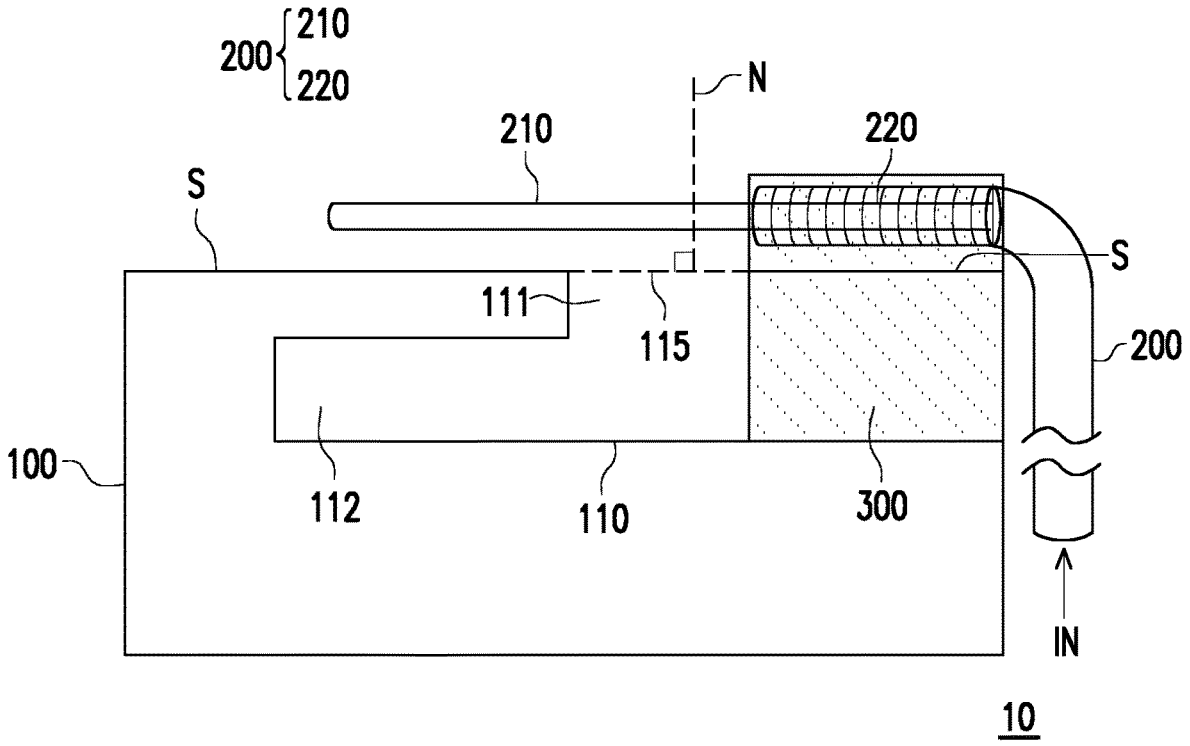
FIG. 1 is a schematic diagram of an antenna device drawn according to an embodiment of the disclosure.

Reference will now be made in detail to the embodiments of the disclosure, examples of which are illustrated in the accompanying drawings. Wherever possible, the same reference numbers are used in the drawings and the description to refer to the same or like parts. The directional terms mentioned in the disclosure, like "above", "below", "left", "right", "front" or "back", refer to the directions in the appended drawings. Therefore, the directional terms are only used for illustration instead of limiting the disclosure.

It should be understood that although terms such as "first", "second", "a", "an", "another" and "still another" in this specification may be used for describing different elements, the elements are not limited by such terms. The terms are only used to distinguish one element from another element. For example, a first element may be referred to as a second element, and similarly, a second element may also be referred to as a first element without departing from the protection scope of the concepts of the disclosure. For another example, an element may be referred to as another element, and similarly, another element may also be referred to as still another element without departing from the protection scope of the concepts of the disclosure.

FIG. 1 is a schematic diagram of an antenna device 10 drawn according to an embodiment of the disclosure. The antenna device 10 includes a metal component 100, a signal cable 200, and a grounding component 300. The antenna device 10 may be mounted on an electronic device with a wireless communication function such that the electronic device may transmit or receive a wireless signal by the antenna device 10.

The metal component 100 includes a slot 110. The slot 110 includes an open end 111 and a closed end 112. The open end 111 forms an opening 115 at a side S of the metal component 100. The metal component 100 is, for example, a metal casing of the electronic device, or a grounding metal plate in the electronic device, or the like, but the disclosure is not limited thereto. For example, the antenna device 10 may be formed by utilizing the metal casing of the electronic device such that the antenna device 10 instead of a traditional PCB antenna is used by the electronic device for communication.

Figure 2:
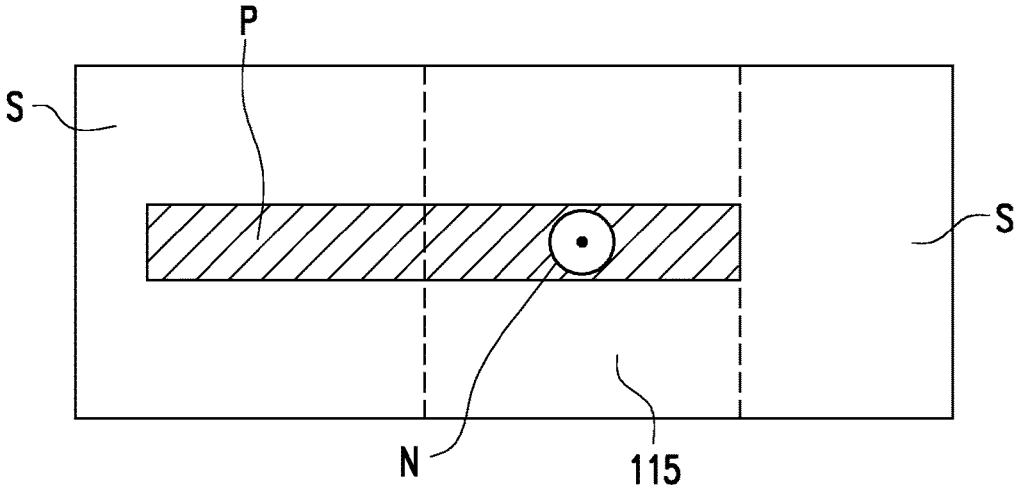
FIG. 2 is a lateral view of a metal component drawn according to an embodiment of the disclosure.

The signal cable 200 includes a signal portion 210 and a grounding portion 220. The signal cable 200 is disposed such that a projection of the signal portion 210 is partially overlapped with the opening 115. In the present embodiment, the projection of the signal portion 210 on the opening 115 is perpendicular to a normal N of the opening 115, but the disclosure is not limited thereto. In other embodiments, a projection of the signal portion 210 on the opening 115 may be not perpendicular to a normal N of the opening 115. FIG. 2 is a lateral view of the metal component 100 drawn according to an embodiment of the disclosure. In one embodiment, a projection P of the signal portion 210 on the opening 115 may pass through a geometrical center of the opening 115. It should be noted that although the opening 115 of the slot 110 in the present embodiment is a quadrangle, the opening 115 may also be of other shapes different from the quadrangle, and the disclosure is not limited thereto. In addition, a distance between the signal portion 210 and the opening 115 may be regulated according to a design demand, but the disclosure is not limited thereto. For example, the signal portion 210 may be very close to the opening 115 such that the signal portion 210 is in contact with the side S of the metal component 100. Or the signal portion 210 may be far away from the opening 115 such that the signal portion 210 is not in contact with the side S of the metal component 100.

The slot 110 is, for example, an L-shaped slot, but the disclosure is not limited thereto. If the slot 110 is the L-shaped slot, the signal portion 210 of the signal cable 200 extends in a direction of a central axis of the closed end 112 of the slot 110. In one embodiment, the signal portion 210 extends in a direction parallel to the central axis of the closed end 112 of the slot 110 and is parallel to the side S of the slot 110.

Referring to FIG. 1 again, the signal cable 200 is, for example, a coaxial cable. Generally speaking, the coaxial cable includes a core, an insulating layer, a shield and insulating plastics from inside to outside. In the present embodiment, the signal portion 210 of the signal cable 200 includes structures such as a core and an insulating layer, and the grounding portion 220 of the signal cable 200 includes structures such as a core, an insulating layer and a shield coating the core and the insulating layer. The shield is, for example, formed by weaving a metal wire or made of a metal material.

The grounding component 300 is, for example, a copper foil, an aluminum foil, or another type of metal sheet, or a conductive fabric tape. The grounding portion 220 may be electrically connected to the metal component 100 through the grounding component 300. For example, the grounding portion 220 and the metal component 100 may be respectively lap-jointed with the grounding component 300 such that the grounding portion 220 is electrically connected with the metal component 100.

Figure 3:
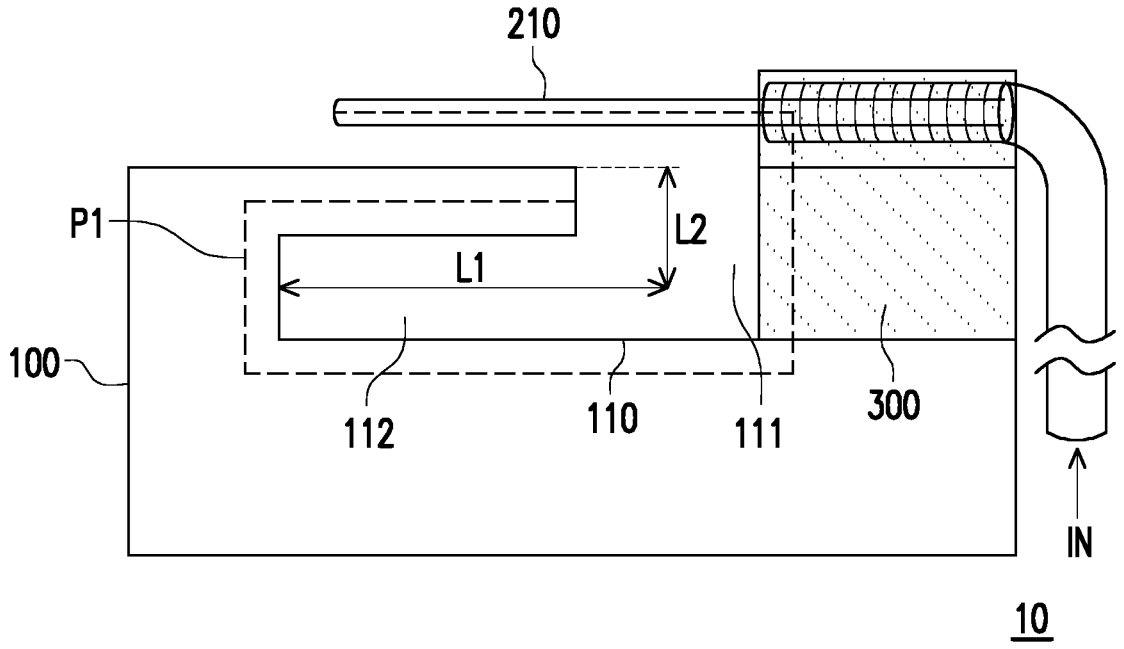
FIG. 3 is a schematic diagram of a resonance path of an antenna device drawn according to an embodiment of the disclosure.

The signal portion 210, the grounding portion 220, and the slot 110 form a current loop. The current loop may be used as a resonance path of the antenna device 10. FIG. 3 is a schematic diagram of a resonance path P1 of the antenna device 10 drawn according to an embodiment of the disclosure. As shown in FIG. 3, a portion, surrounding the slot 110, of the metal component 100 and the signal portion 210 form the resonance path P1.

The antenna device 10 may be disposed to support a first resonance mode and a second resonance mode. The first resonance mode corresponds to a low frequency band, and the second resonance mode corresponds to a high frequency band. For example, the first resonance mode may correspond to 2.4 GHz, and the second resonance mode may correspond to 5 GHz, but the disclosure is not limited thereto.

In order to make the antenna device 10 support the two resonance modes at the same time, a length of the resonance path P1 of the antenna device 10 requires to be designed. The resonance path P1 may be decided by a length of the slot 110 and a length of the signal portion 210. For example, it is supposed that the slot 110 is an L-shaped slot, the closed end 112 of the slot 110 corresponds to a first side, with a side length L1, of the L-shaped slot, and the open end 111 of the slot 110 corresponds to a second side, with a side length L2, of the L-shaped slot, the first side length L1, the second side length L2, and the length of the signal portion 210 are disposed to form the resonance path P1.

Figure 4A:
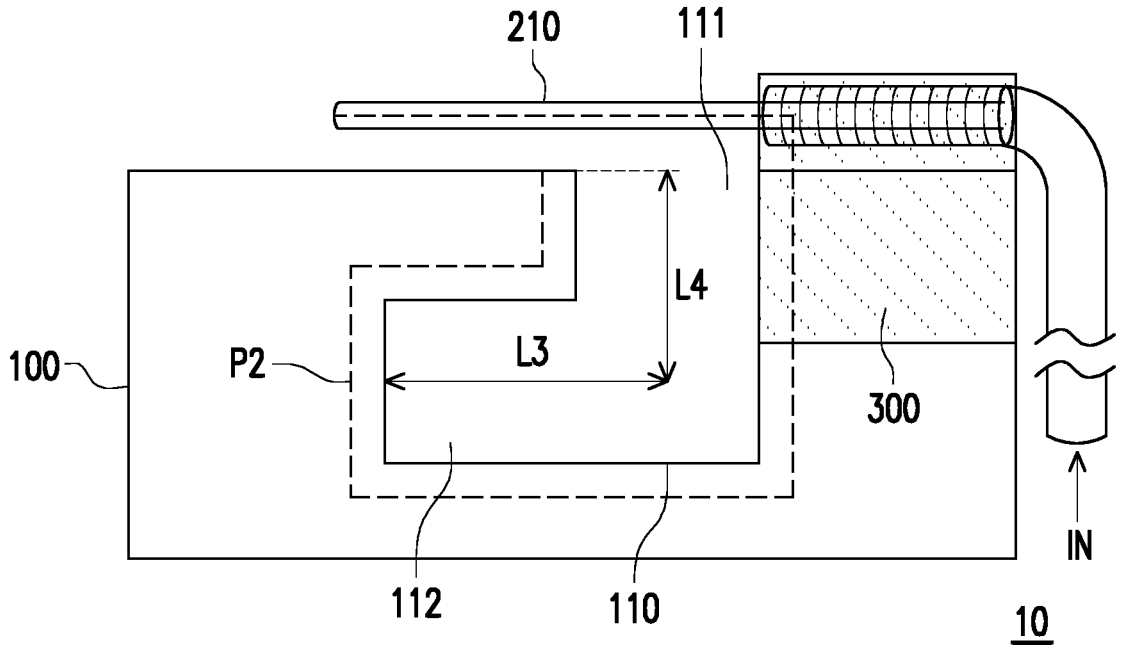
FIGS. 4A, 4B and 4C are schematic diagrams of antenna devices provided with slots configured to be different according to embodiments of the disclosure.
Figure 4B:
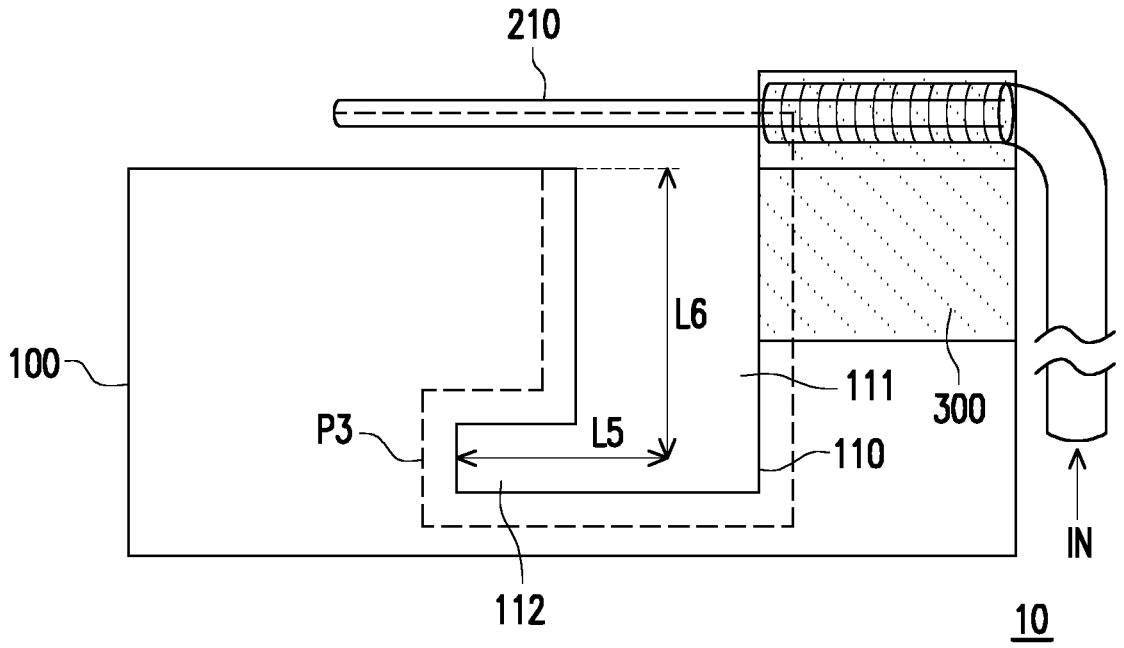
Figure 4C:
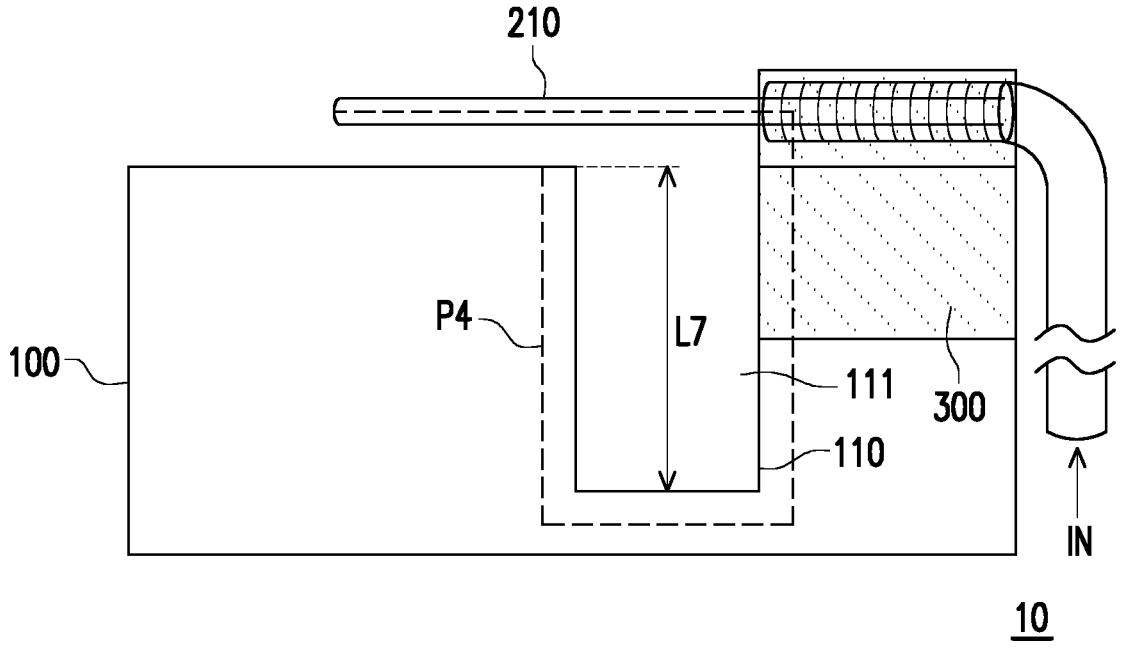

FIGS. 4A, 4B and 4C are schematic diagrams of antenna devices 10 with slots configured to be different according to embodiments of the disclosure. In order to change a length of a resonance path, the length of the slot 110 may be regulated. Referring to FIG. 3 and FIG. 4A, a length of the first side corresponding to the closed end 112 of the slot 110 may be regulated from the side length L1 to a side length L3, and a length of the second side corresponding to the open end 111 of the slot 110 may be regulated from the side length L2 to a side length L4. The side length L3 is different from the side length L1, and the side length L4 is different from the side length L2. Thus, the resonance path P1 may be regulated to be a resonance path P2 after the side length L1 and the side length L2 are respectively disposed to be the side length L3 and the side length L4.

Similarly, referring to FIG. 3 and FIG. 4B, the length of the first side corresponding to the closed end 112 of the slot 110 may be regulated from the side length L1 to a side length L5, and the length of the second side corresponding to the open end 111 of the slot 110 may be regulated from the side length L2 to a side length L6. The side length L5 is different from the side length L1, and the side length L6 is different from the side length L2. Thus, the resonance path P1 may be regulated to be a resonance path P3 after the side length L1 and the side length L2 are respectively disposed to be the side length L5 and the side length L6.

In one embodiment, the slot 110 may be changed from the L-shaped slot to an I-shaped slot when the length of the first side corresponding to the closed end 112 of the slot 110 is regulated to be zero. Referring to FIG. 3 and FIG. 4C, the length of the first side corresponding to the closed end 112 of the slot 110 may be regulated from the side length L1 to zero, and the length of the second side corresponding to the open end of the slot 110 may be regulated from the side length L2 to a side length L7. The side length L7 is different from the side length L2. Thus, the resonance path P1 may be regulated to be a resonance path P4 after the side length L1 and the side length L2 are respectively disposed to be zero and the side length L7.

The resonance path of the antenna device 10 may be disposed such that the antenna device 10 may support the first resonance mode corresponding to the low frequency band and the second resonance mode corresponding to the high frequency band at the same time. Referring to FIG. 3, in order that the first resonance mode of the antenna device 10 has relatively high efficiency, the slot 110 and the signal portion 210 may be disposed such that the length of the resonance path P1 is equal to a ½ wavelength of the low frequency band. For example, it is supposed that a feed-in signal IN supported by the first resonance mode is in the low frequency band which is 2.5 GHz, in order that the feed-in signal IN meets a resonance condition and the radiation efficiency of an antenna is improved, a length of the closed end 112, a length of the open end 111, and the length of the signal portion 210 may be disposed such that the length of the resonance path P1 is equal to the ½ (about: 6 cm) wavelength of the low frequency band which is 2.5 GHz.

On the other hand, it is supposed that a feed-in signal IN supported by the second resonance mode is in the high frequency band which is 5 GHz, in order that the feed-in signal IN meets a resonance condition and the radiation efficiency of an antenna is improved, the length of the closed end 112, the length of the open end 111, and the length of the signal portion 210 may be disposed such that the second resonance mode of the length of the resonance path P1 is the wavelength (about: 6 cm) of the high frequency band which is 5 GHz.

Therefore, the resonance path P1 may meet resonance conditions of a 2.5 GHz signal and a 5 GHz signal at the same time when the length of the resonance path P1 is about 6 cm. The antenna device 10 with the 6 cm resonance path P1 will have high radiation efficiency when transmitting or receiving the 2.5 GHz signal and/or the 5 GHz signal.

Based on the above, the antenna device with the small size may be composed by the metal component existing in the electronic device and the coaxial cable. In addition, the antenna device may support at least two resonance modes at the same time so as to respectively adapt to different-frequency signal transmission.

Although the disclosure is described with reference to the above embodiments, the embodiments are not intended to limit the disclosure. A person of ordinary skill in the art may make variations and modifications without departing from the spirit and scope of the disclosure. Therefore, the protection scope of the disclosure should be subject to the appended claims.

What is claimed is:

1. An antenna device, comprising:

a metal component, comprising a slot, wherein the slot comprises an open end and a closed end, and the open end forms an opening at a side of the metal component;

a signal cable, comprising a signal portion and a grounding portion, wherein the signal cable is disposed such that a projection of the signal portion is partially overlapped with the opening, wherein the projection of the signal portion is perpendicular to a normal of the opening; and a grounding component, wherein the grounding portion is electrically connected to the metal component through the grounding component.

2. The antenna device according to claim 1, wherein the slot is an L-shaped slot.

3. The antenna device according to claim 2, wherein the signal portion extends in a direction of a central axis of the closed end.

4. The antenna device according to claim 1, wherein a portion, surrounding the slot, of the metal component and the signal portion form a resonance path.

5. The antenna device according to claim 4, wherein the antenna device supports a first resonance mode and a second resonance mode, wherein the first resonance mode corresponds to a low frequency band, and the second resonance mode corresponds to a high frequency band.

6. The antenna device according to claim 5, wherein the slot and the signal portion are disposed such that a length of the resonance path is equal to a ½ wavelength of the low frequency band.

7. The antenna device according to claim 5, wherein the slot and the signal portion are disposed such that a length of the resonance path is equal to a wavelength of the high frequency band, wherein a frequency of the high frequency band is an integer multiple of that of the low frequency band.

8. The antenna device according to claim 4, wherein the slot is an L-shaped slot;

the closed end corresponds to a first side, with a first side length, of the L-shaped slot; and the open end corresponds to a second side, with a second side length, of the L-shaped slot, wherein the first side length, the second side length and a length of the signal portion are disposed to form the resonance path.

9. The antenna device according to claim 1, wherein the signal cable is a coaxial cable;

the grounding portion is made of a metal material; and the signal portion comprises a core and an insulating layer.

* * * * *